United States Patent [19]

Emery

[11] Patent Number: 4,625,908

[45] Date of Patent: Dec. 2, 1986

[54] CONTAINER LOCK CONSTRUCTION

[76] Inventor: Roy W. Emery, 1 Donino Court, Toronto, Ontario, Canada, M4N 2H6

[21] Appl. No.: 546,906

[22] Filed: Oct. 31, 1983

[51] Int. Cl.[4] ..... B65D 45/00

[52] U.S. Cl. ..... 229/45 R; 229/52 BC; 206/427

[58] Field of Search ..... 229/45 R, 52 BC; 206/427

[56] References Cited

U.S. PATENT DOCUMENTS

| | | | |
|---|---|---|---|
| 2,116,336 | 5/1938 | Boeye | 229/45 R |
| 2,593,895 | 4/1952 | Kohl | 229/45 R |
| 2,900,123 | 8/1959 | Drnec et al. | 229/45 R |
| 3,055,570 | 9/1962 | Hamilton | 229/45 R |
| 3,064,877 | 11/1962 | Forrer et al. | 229/45 R |
| 3,100,056 | 8/1963 | Friday, Jr. | 229/45 R |
| 3,282,462 | 11/1966 | Box | 229/45 |
| 3,314,587 | 4/1967 | Johnson | 229/45 |
| 3,371,848 | 3/1968 | Ward et al. | 229/45 |
| 3,752,385 | 8/1973 | Woodgate | 229/45 R |
| 4,093,068 | 6/1978 | Smrt | 206/522 |
| 4,225,077 | 9/1980 | Veitinger | 229/45 R |

FOREIGN PATENT DOCUMENTS

| | | | |
|---|---|---|---|
| 951305 | 3/1964 | United Kingdom | 229/45 |

*Primary Examiner*—Joseph Man-Fu Moy
*Attorney, Agent, or Firm*—Fetherstonhaugh & Co.

[57] ABSTRACT

A moulded container comprising bottom, side walls at right angles to the bottom; a top closure, said top closure comprising flaps hinged to the upper edges of opposed side walls, locking panel means adapted to overlie container contents in use and to be juxtaposed to the top closure of the container when the top closure is closed, said locking panel means having a locking panel interlock means, said flaps of said top closure having closure interlock means integrally moulded therein adapted to cooperate with the locking panel interlock means in interlocking relation when the top closure is closed whereby the top closure is retained closed and the locking panel extends across the opposed free edges of said flaps; said closure interlock means and said locking panel interlock means being accessible when in interlocked relation from the exterior of said top closure for release from interlocking relation; the locking panel interlock means having resilience to flex as the flaps are closed to permit the locking panel interlock means and the closure interlock means to enter into cooperative interlocking relation and to permit the said interlocking relation for opening of the flaps on manual manipulation.

4 Claims, 7 Drawing Figures

51
51
70
72
73
71
6
6
74
60
58
77
66
77
76
62
64
68
71
72
72
76
77
73
71
74
51
72
70

CONTAINER LOCK CONSTRUCTION

This invention relates to a moulded container with a top closure and a releasable lock. It is contemplated that the container may be moulded from any suitable material such as wood pulp fiber or a suitable plastics material. The invention will be described as being made from a wood pulp fiber.

Wood pulp fiber is a popular material for moulding one piece containers with a hinged top closure and a releaseable lock. They are used extensively for the packaging of eggs in convenient sizes such as one dozen, one half dozen, and one and a half dozen.

In an egg container wherein the top and the bottom of the container is divided into cells each of which is designed to accept one egg, the cell configuration results in a container that does not have side walls that extend at right angles from the bottom or from the top. It is usual for the side walls on the bottom section to slope upwardly and outwardly and the side walls on the top section to slope downwardly and outwardly. In use, the locking means depends on the slope and flexibility of the side wall of the top section for its operation. The sloped wall construction limits the stacking strength of container, and the container cannot be stacked as high as a comparable container with vertical side walls. Its utility has thus been restricted.

In the case of egg containers, a releasable lock is provided that automatically engages as the top is closed upon the bottom and that can be manually released by separating the interlocked parts carried by each of the bottom and the top of the container. Such a lock must accept the full load of maintaining the top in closed position.

This invention relates to a locking configuration for closing a moulded container wherein the side walls of the container can extend upwardly and at right angles to the bottom wall and also at right angles to the closed top wall.

The provision of a reliable and simple repeatable closure and locking means for a moulded container having vertical side walls greatly extends the utility of the moulded container.

A moulded container according to the present invention comprises bottom, side walls at right angles to the bottom; a top closure, said top closure comprising flaps hinged to the upper edges of opposed side walls, locking panel means adapted to overlie container contents in use and to be juxtaposed to the top closure of the container when the top closure is closed, said locking panel means having a locking panel interlock means, said flaps of said top closure having top closure interlock means integrally moulded therein adapted to cooperate with the locking panel interlock means in manually releasable interlocking relation when the top closure is closed whereby the top closure is retained closed and the locking panel extends across the opposed free edges of said opposed flaps; said top closure interlock means and said locking panel interlock means being accessible when in interlocked relation from the exterior of said top closure for release from interlocking relation; the interlock means on the top closure and on the locking panel interlock being adapted to engage and to flex with respect to each other as the flaps are closed to permit the locking panel interlock means and the top closure interlock means to enter into cooperative interlocking relation and to permit manual release of the said interlocking relation on manual manipulation.

Figure 1:
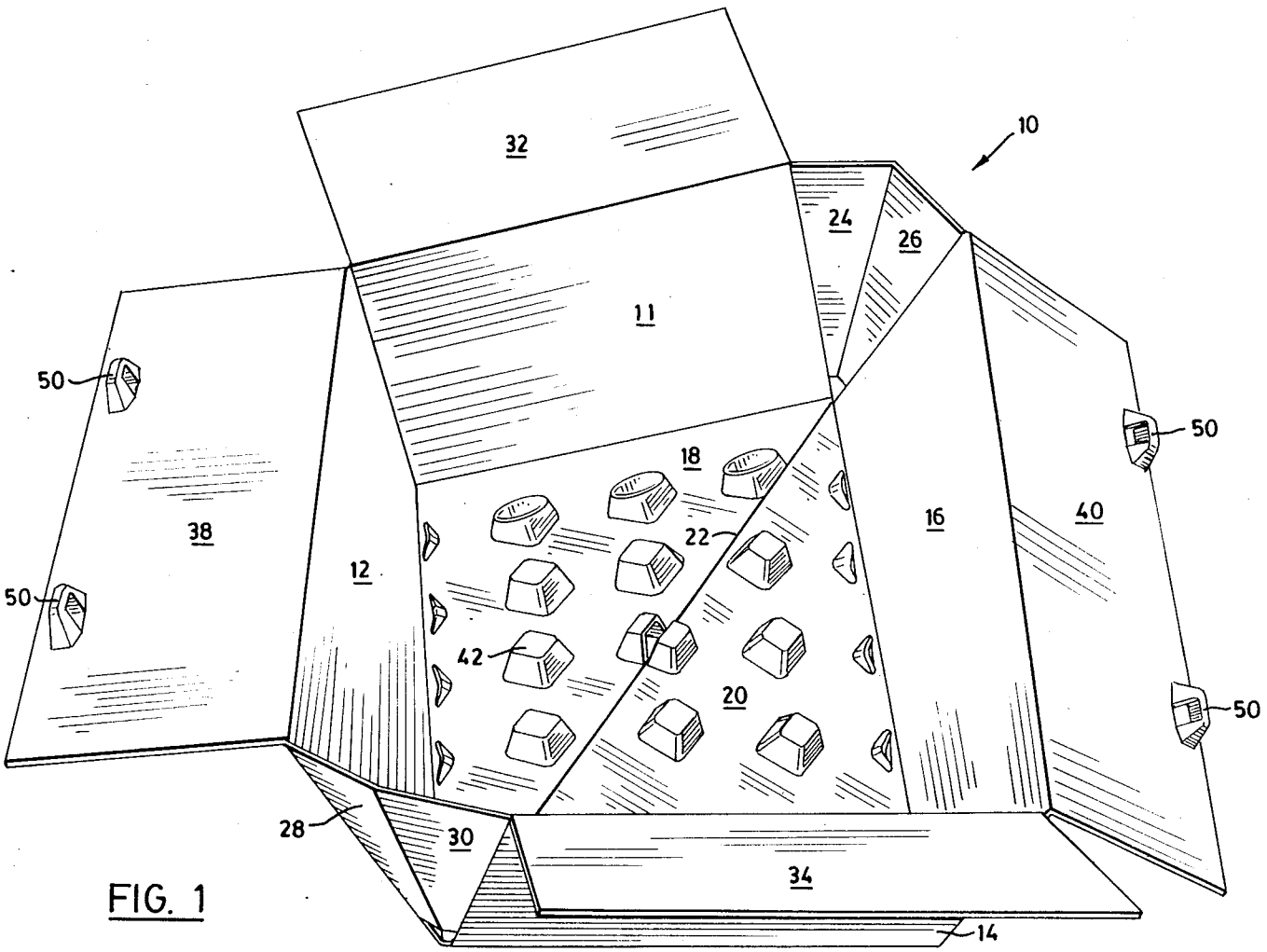
FIG. 1 is an illustration of a moulded blank of an embodiment of the invention in the form it is removed from the mould.

In the drawings, the numeral 10 refers to a container blank after it has been removed from the mould upon which it is formed. This blank has been formed from wood pulp fiber by the slush moulding process wherein fibers are attracted by vacuum to a foraminous mould having the shape of the container. The container has side walls 11, 12, 14 and 16, a bottom which at the time of moulding is in two portions 18 and 20 joined by a foldline 22. The sections 18 and 20 in the container illustrated are moulded at a dihedral angle of about 30 degrees along the crease line 22. The purpose of moulding the bottom of the container with a crease line 22 and with the two sections at an angle to each other is to permit easy removal of the moulded container from the mould. This broad concept of moulding the container with the side walls at right angles to the bottom is not new with the present invention and was described in my issued U.S. Pat. No. 4,269,345 dated May 26, 1981 for an invention entitled "Nestable Moulded Container". No claim is made to this broad concept in the present application.

As noted, the container illustrated in FIG. 1 has side walls 11 and 12 moulded at right angles to the bottom section 18 and side walls 16 and 14 moulded at right angles to the bottom section 20. It will also be noted that the side walls 11 and 16 are joined by triangular panels 24 and 26 and that the side walls 12 and 14 are joined by triangular panels 28 and 30. These panels are defined along their longitudinal edges by crease lines and are of proportions such that when the bottom sections 18 and 20 are hinged along line 22 to assume a common plane the sections 24 and 26 and the sections 28 and 30 can be folded upon each other to assume a position juxtaposed to the end walls 10 and 14 respectively.

Figure 2:
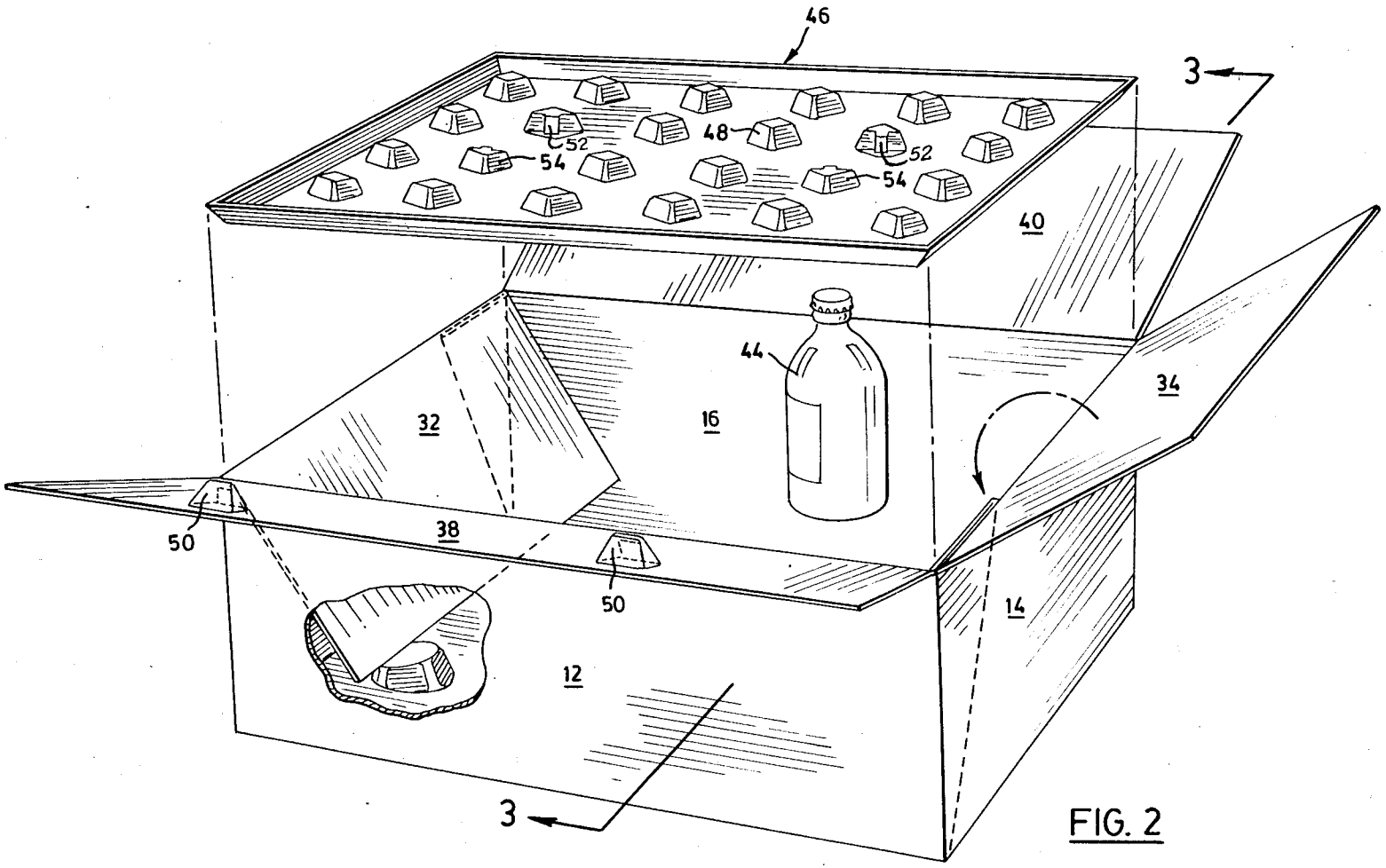
FIG. 2 is an illustration of the blank of FIG. 1 as it is being set up for use to contain bottles.

This is illustrated in FIG. 2 of the drawings.

Hold-down flaps 32 and 34 are folded inwardly to overlie the folded panels 24 and 26 and the folded panels 28 and 30 respectively as illustrated in FIG. 2, so that when the container is set up it has a bottom, side walls at right angles to the bottom and closure flaps 38 and 40 which can be hinged inwardly to form a top closure.

Figure 3:
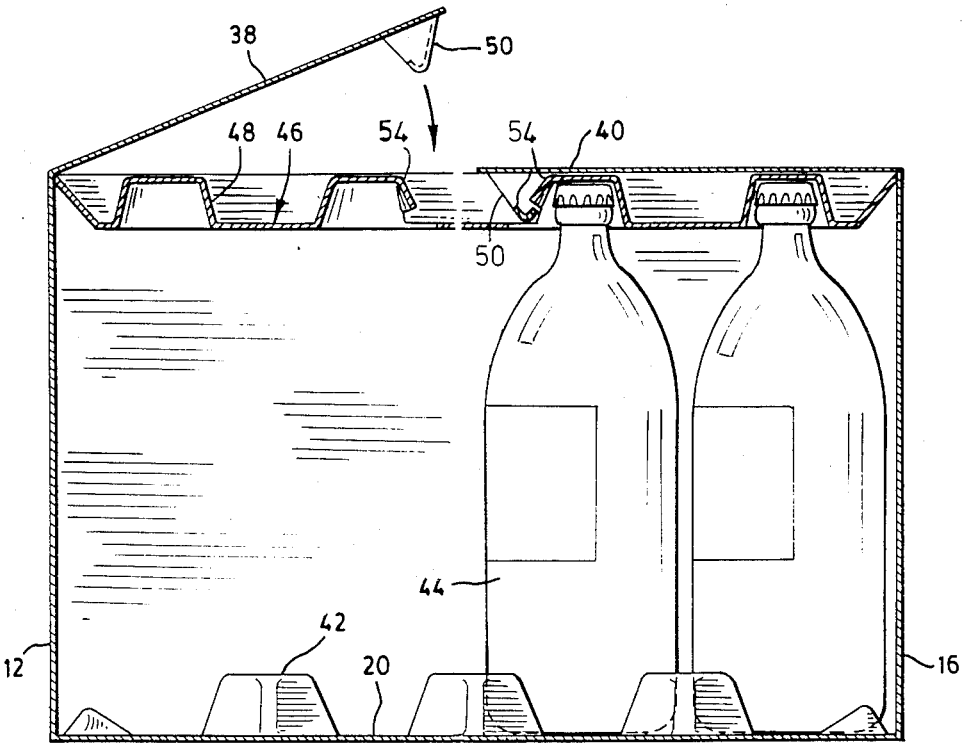
FIG. 3 is a sectional view along the line 3—3 of FIG. 2 but showing the container partly closed.

Blisters 42 are moulded into the bottom of the container and are spaced apart to locate bottles 44 that are loadable into the container for shipment. A locking panel 46 separately moulded by a similar process to the container is insertable in the top opening of the container after it has been loaded with bottles and is also formed with blisters 48 and 54 that are aligned with the tops of bottles loaded within the container to restrain the bottles from lateral displacement as illustrated in FIG. 3.

Thus, bottles loaded within the container are restrained from lateral movement by means of the blisters on the bottom of the container and by means of blisters on the locking panel 46 at the top of the container.

The top closure for the container is one that is easy to close. It locks automatically upon manipulation of the top flaps to a closed position. It is also easy to open.

Figure 4:
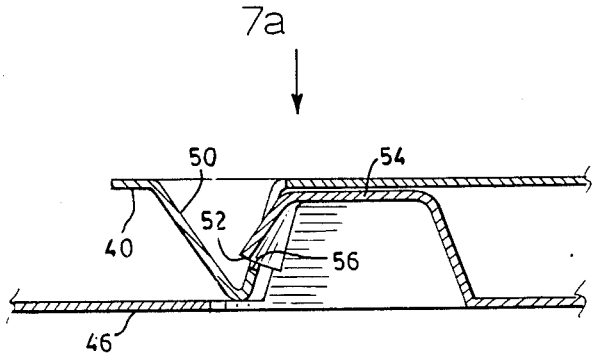
FIG. 4 is a detail illustrating the interlock between a flap of the top closure and the locking panel.

The top closure for the container is easily incorporated in the container by moulding techniques. It makes use of blister 50 moulded into the top flaps 38 and 40 which together constitute the top closure. These blisters 50 each have an opening, the lower edge of which defines the lip 56. Lip 56 interlocks with the shoulder on the bottom of a locking boss 52 on the blisters 54 formed on the locking panel 46. The top flaps flex to permit interlocking of these parts as shown in FIG. 4. To open the flaps one can insert a finger into blister 50 and exert pressure against the wall thereof to flex the flap in which the blister is formed to move the lip 56 from underlying relation with the shoulder on the bottom of the locking boss formed on the diaphragm 55 of the blister 54. (FIG. 4) There is sufficient flexibility in the flaps and blisters to permit the manual release of the interlocked parts.

FIG. 4 illustrates the closure flap and the locking panel 46 in locked position wherein the locking panel overlies the container contents and is maintained in juxtaposed relation to the top closure panels 38 and 40. It is manipulated to this position by merely closing the top panels over the locking panel. The locking bosses 52 formed on the diaphragm wall 55 and the top flaps 38 and 40 have sufficient relative flexibility to permit relative deflection and reasserting to assume the locked position of FIG. 4 as the flaps are completely closed down.

Thus, a moulded container having side walls that are at right angles to the bottom has been provided with a top closure that can be simply closed and then manipulated to the open position. The container is, by reason of the locating blisters on the bottom wall and locking panel, able to maintain the bottles packed therein against lateral displacement. The vertical wall container of moulded material is especially useful for situations where it is desired to stack a large number of containers one upon the other because of the inherent strength and stability of the vertical walls in such a situation. There has been provided a lightly loaded latch arrangement for the top closure in a container of rectangular configuration with a flat lid. The locking panel acts as a bridge between the fold lines of the top closure panels. The locking mechanism is located below the principal plane of the top closure and this feature of the locking mechanism makes it possible to extend the sides of the box to full height with the hinge for the top cover effectively at the level of the flat container top. This feature greatly enhances the stacking strength of the container. Locking arrangements of the general type illustrated have been used on egg containers, but the configurations have only been adaptable for containers with sloping sides from the top closure wherein the hinge line is positioned at a lower level to the top surface of the container. In such an arrangement pressure on the top of the container deflects the hinge line outwardly and reduces the stacking efficiency of the container.

In the embodiment illustrated in FIGS. 1 to 4 the interlocking blister of the interlock means for the locking panel has been incorporated into one of the locating blisters. It could be separately formed. Many configurations for the locking means are possible within the scope of the invention.

The container as illustrated in the embodiment of FIG. 1 is manufactured from two portions, one portion consisting of a triangular bottom wall segment 18 and two side walls 11 and 12 formed in upstanding relation with respect to the bottom wall and the other segment also consisting of a triangular bottom wall 20 and side walls 14 and 16; the two segments being joined along a hinge line 22. The side walls of each of the container portions that terminate at the end of the triangular bottom of each container portion are joined by webs having panels 24 and 26 at one corner and 28 and 30 at the opposed corner as previously explained. This arrangement permits the assembly of the container without the use of any adhesives or other connective materials of any kind. It will be recalled that the container can be set up as illustrated in FIG. 2, filled with contents and then closed as illustrated in FIGS. 3 and 4. No glue is used and this is a particular advantage if the container is to be reused.

Many containers used to package beverages such as beer are returned with empty beer bottles in a condition that they can be reused. With the container of this invention it is merely necessary to unlock and open the container, remove locking panel the bottles, lift up the securing flaps 32 and 34 and spread the container in a nestable position for stacking. Thus, used containers can be knocked down and stacked in a pile without breaking any glue. This is thought to be a very substantial advantage in many uses of the container.

Figures 5, 6:
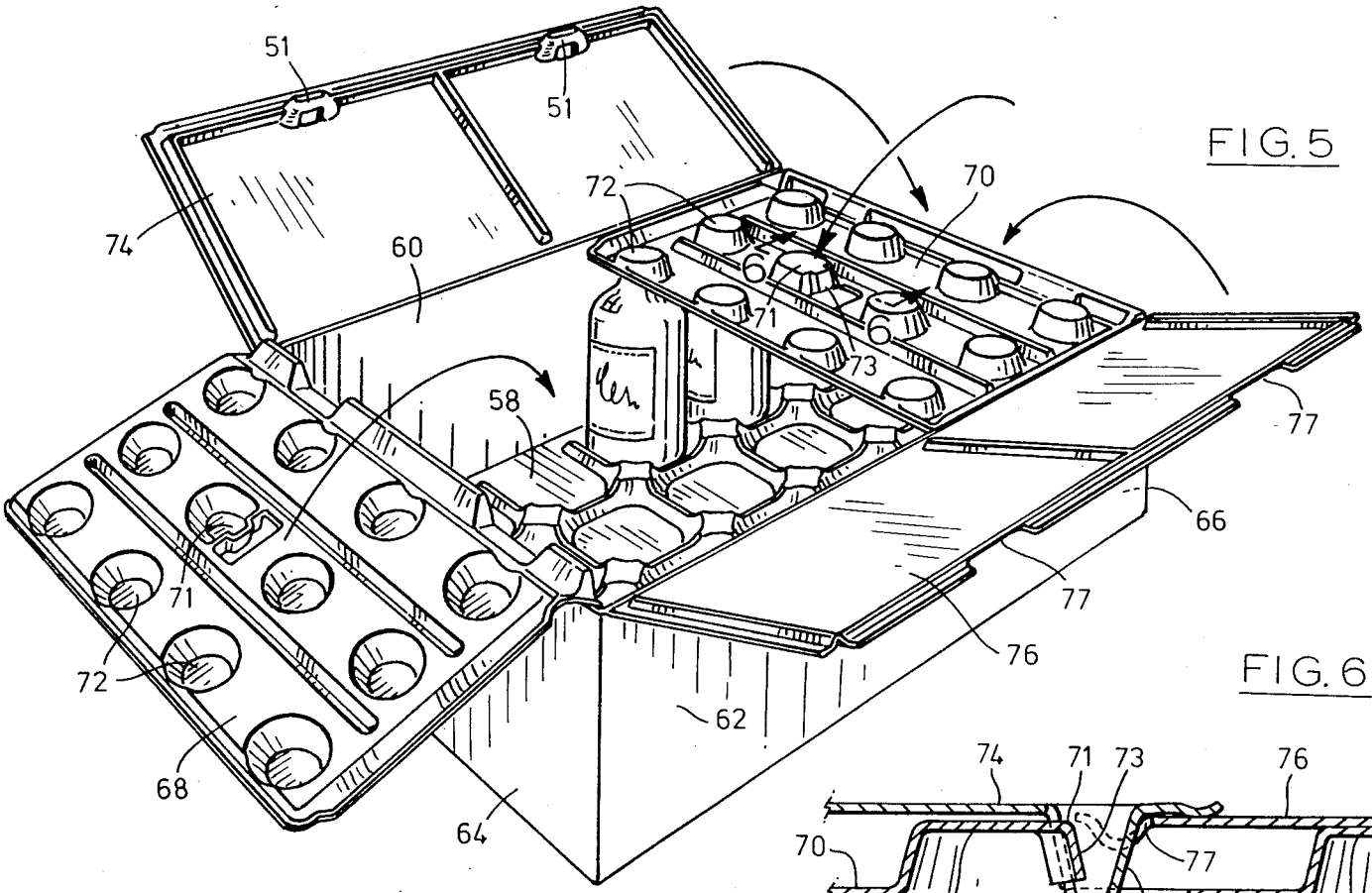
FIG. 5 is an alternative form of container.
FIG. 6 is a view along the line 6—6 of FIG. 5 but showing the closure flaps closed; and FIG. *7a* shows open and closed plan views of the lock taken on the arrows *7a* of FIG. 4.
Figure 7A:
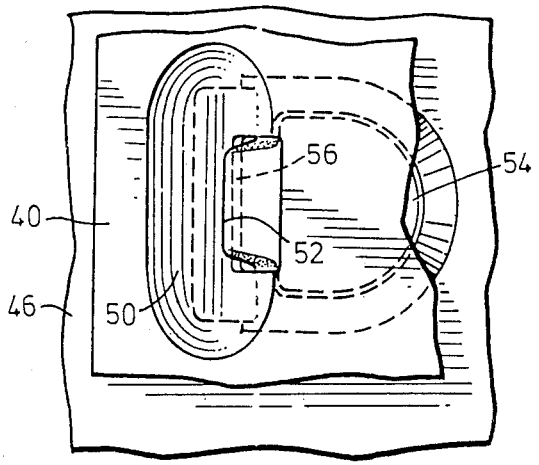

FIG. 5 illustrates an alternative form of the invention wherein the function of the locking panel is provided by interlocking structure formed on end flaps hinged to the walls. In this case, however, the corner will generally be secured by glue or staples if the triangular gusset formation of FIG. 1 is used. Alternatively, one of the walls at each of the corners where the gusset formation is shown in FIG. 10 can be formed with a tab that is glued or stapled to the adjacent wall when the container is in a set-up position similar to that described in U.S. Pat. No. 4,269,345 dated May 26, 1981 to Roy W. Emery.

In either of these alternatives glue or staples must be used at the corners of the container where the gusset is illustrated in FIG. 1.

FIG. 5 is in illustration of a container that avoids the use of the locking panel 46 of the embodiment of FIGS. 1 and 2. In this case the container has locating flaps 68 and 70 which are hinged to the side walls 64 and 66 respectively. These locating flaps have blisters 72 that serve the function of the blisters 48 on the insertable locating panel 46 of the embodiment of FIGS. 1 and 2. Flaps 74 and 76 hinged to side wall 60 and 62 respectively are closure flaps.

Closure flap 74 has blisters 51 formed therein which are adapted to interlock with specially formed blisters identified by the numeral 71 on the locating flaps to form a closure that is similar in principle to the closure illustrated in connection with the embodiment of FIGS. 1 and 2.

In the use of the embodiment illustrated in FIG. 5, the locating flaps 68 and 70 are first closed and, as illustrated, the locating blisters therein will engage with the top of a bottle to cooperate with formations on the bottom of the container to positivel locate the bottle within the container. The locating flaps being closed, the closure flap 76 is closed. After closing of the flap 76, closure flap 74 is closed. As flap 74 closes, the lower edge of the opening in the blister 51 springs over and underlies the lower edge of the locking boss 73 of the blister 71 which, as noted above is a specially formed locating blister 72.

The locking boss 73 formed on a face of the locking blister 71 is similar in design to the locking boss 52 on the locking blister 54 of the previously described embodiment. FIG. 6 is a cross sectional view along the line 6—6 of FIG. 5, but with the closure flaps closed to illustrate the closure. It will be noted that flap 74 has an edge that overlies the marginal portion of flap 76 to retain the closure. A cut-out 77 is provided in closure flap 76 to accommodate the extension of the blister 51 to the interlocking relation with the boss 73 of the locking blister 71.

In principle, the operation of the locking means illustrated in FIGS. 5 and 6 is similar to that illustrated in FIGS. 2 and 3. There is relative resilience between the parts to permit the locking upon closure which can be manually released by flexing the parts as one inserts one's finger into the open portion of the locking blisters 51.

It will be apparent that the construction illustrated in FIGS. 5 and 6 is a one piece moulded construction that can be used to maintain bottles in location without the use of externally formed dividers. It can be simply closed and locked in a closed position and just as simply released from the locked position to remove the contents.

Embodiments of the invention other than the one illustrated will be apparent to those skilled in the art and it is not intended that the embodiments illustrated should be read in a limiting sense.

What I claim as my invention is:

1. A moulded container comprising bottom, side walls at right angles to the bottom; a top closure, said top closure comprising flaps hinged to the upper edges of opposed side walls; said bottom, side walls and top closure being made and formed by a moulding process, locating panel means adapted to overlie container contents in use and to be juxtaposed to the top closure of the container when the top closure is closed, said locating panel means being formed with blisters with their openings facing downwardly to embrace and locate the upper end of an article in the container in use, at least one of said flaps of said top closure having a second interlock means integrally moulded therein said second interlock means including a blister with its opening facing upwardly and having a surface adapted to cooperate with the first interlock means in manually releasable interlocking relation when the top closure is closed whereby the top closure is retained closed and the locking panel extends across the opposed free edges of said opposed flaps; said top closure interlock means and said locking panel interlock means being accessible from the upwardly facing opening of the blister of the first interlock means when in interlocked relation from the exterior of said top closure for manual release from interlocking relation; the second interlock means and the first interlock means being adapted to engage and to flex with respect to each other as the flaps are closed to permit the first and second interlock means to enter into cooperative interlocking relation and to permit manual release of the said interlocking relation on manual manipulation.

2. A moulded container as claimed in claim 1 in which said first interlock means includes a boss formed on its respective blister and said second interlock means includes an opening in its respective blister, the boss being adapted to latch in the opening when the first and second interlock means are in interlocking relationship.

3. A moulded container as claimed 1 in which said locking panel means is formed independently of the container.

4. A moulded container as claimed in claim 1 in which said locking panel means is hingedly connected to said side walls of the container.

* * * * *